United States Patent [19]

Swanson

[11] Patent Number: 4,600,373

[45] Date of Patent: Jul. 15, 1986

[54] CONCRETE PIPE MACHINE

[75] Inventor: Harold V. Swanson, Sparta, N.J.

[73] Assignee: GHA Lock Joint, Inc., Parsippany, N.J.

[21] Appl. No.: 357,196

[22] Filed: Mar. 11, 1982

[51] Int. Cl.[4] ..... B28B 21/34; B28B 21/78

[52] U.S. Cl. ..... 425/144; 264/40.6; 264/311; 425/432; 425/435

[58] Field of Search ..... 425/144, 143, 435, 432, 425/425; 264/311, 40.6

[56] References Cited

U.S. PATENT DOCUMENTS

| | | | |
|---|---|---|---|
| 1,203,543 | 10/1916 | Haymaker et al. | 425/425 |
| 2,342,801 | 2/1944 | Guerci | 264/86 |
| 2,671,260 | 3/1954 | Jessen et al. | 264/311 X |
| 2,703,916 | 3/1955 | Butler | 425/429 |
| 2,772,466 | 12/1956 | Van Rensselaer | 425/365 |
| 2,829,418 | 4/1958 | Truswell | 425/435 X |
| 3,566,439 | 3/1971 | Mouly et al. | 425/144 |
| 3,718,721 | 2/1973 | Gould et al. | 425/144 X |
| 3,824,479 | 7/1974 | Alger | 425/144 X |
| 3,950,118 | 4/1976 | Adair | 425/144 |

*Primary Examiner*—Jay H. Woo
*Assistant Examiner*—James C. Housel
*Attorney, Agent, or Firm*—Charles E. Baxley

[57] ABSTRACT

A machine for fabricating sulfur concrete pipe includes a centrifuge for centrifuging a mixture of the constituents of the sulfur concrete. The centrifuge includes a port for the direction of heat therethrough for heating the mixture. The centrifuge also includes a flexible cylindrical wall which may be directed radially inwards for compacting the mixture in response to a fluid pressure exerted on a side of said flexible cylinder opposite from said mixture. Thermometers are provided for measuring the temperature of applied heat at different points within said centrifuge, and a computer is responsive to the measured temperatures for computing future values of temperature to be applied to said mixture in accordance with a predetermined relationship based on past temperature and time of centrifuging.

8 Claims, 1 Drawing Figure

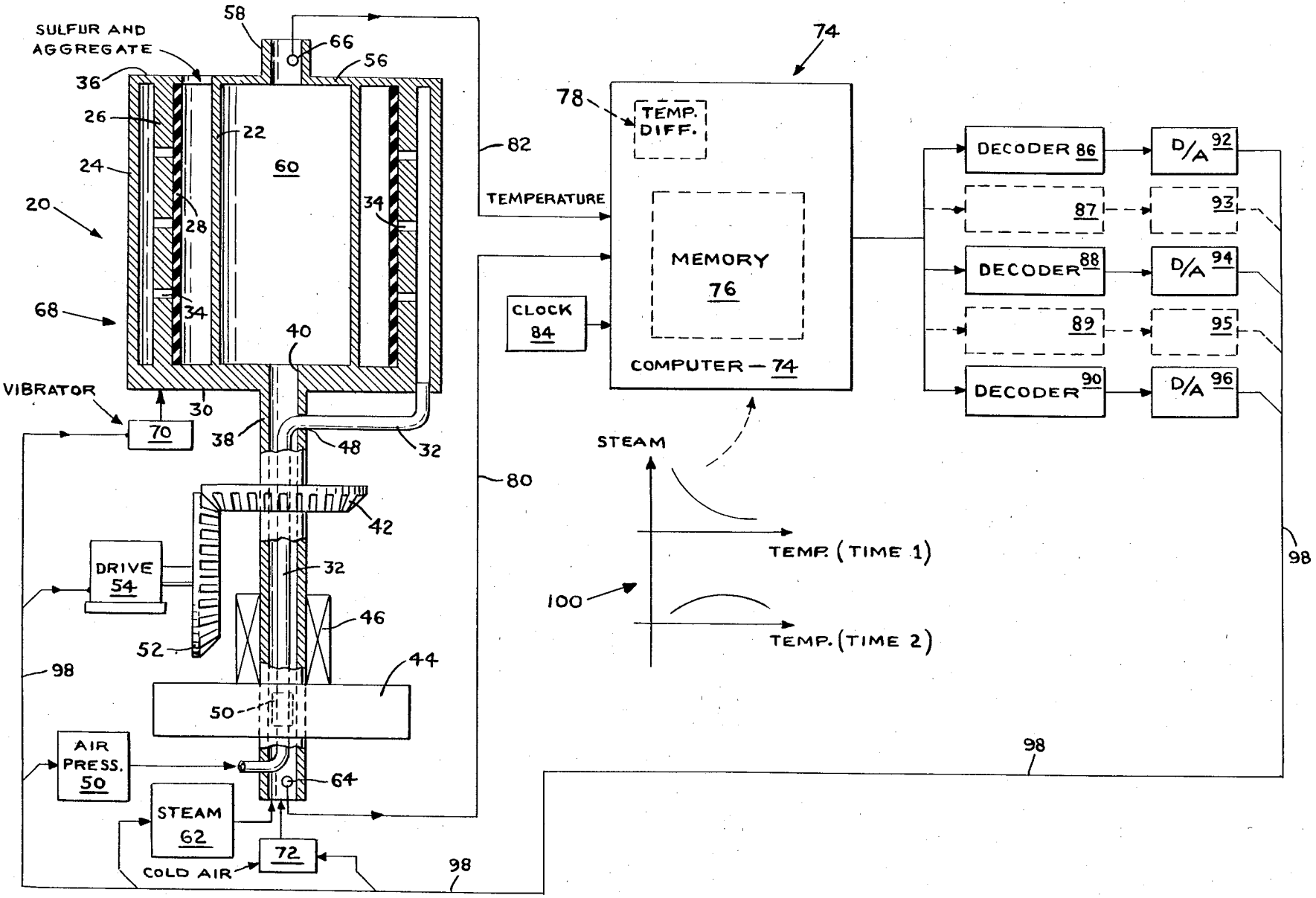
D/A 92
93
D/A 94
95
D/A 96
DECODER 86
87
DECODER 88
89
DECODER 90
98
74
MEMORY 76
COMPUTER — 74
TEMP. DIFF.
78
TEMPERATURE
CLOCK 84
82
80
STEAM
TEMP. (TIME 1)
TEMP. (TIME 2)
100
SULFUR AND AGGREGATE
36
26
24
20
68
VIBRATOR
70
58
66
56
60
22
28
34
30
38
40
48
32
42
46
44
50
52
DRIVE 54
AIR PRESS. 50
64
STEAM 62
72
COLD AIR

CONCRETE PIPE MACHINE

BACKGROUND OF THE INVENTION

This invention relates to machinery for fabricating concrete pipe and, more particularly, to machinery for varying the temperature and pressure as is required for fabricating a pipe composed of a sulfur cement and aggregate.

Concrete composed of Portland cement is widely used in the construction industry. Such concrete has been utilized both for flat objects, such as walls and floors, as well as more complex objects, such as pipes. While such concrete has provided good service over long periods of time in many environments, problems have arisen in the use of such concrete in corrosive atmospheres as well as in the desert.

Recently, another form of concrete employing a sulfur cement in lieu of the Portland cement has shown great promise in resisting corrosion and in withstanding the environment of a desert.

However, problems have arisen in the fabrication of objects, be they blocks or pipes, fabricated from the sulfur concrete due to unknown long term effects of various manufacturing processes employed. In particular, by way of contrast with Portland cement which is mixed with a sand aggregate and water, the sulfur cement may be either in liquid or solid form at the time of the mixing with the aggregate. Other considerations arise in the preparation of sulfur concrete. No water is used in sulfur concrete. In addition, the sulfur concrete is a poor conductor of heat. Further, the sulfur cement must be liquified by heating during some part of the fabrication process, either before mixing or subsequent to the mixing with the aggregate.

The complexity of the manufacturing process is increased with the manufacture of sulfur concrete pipes and tubing in that centrifuging generally is used to provide a desired round cylindrical surface. To avoid stresses built up in the sulfur concrete material during the curing and cooling of the pipe, it is desirable for the pipe manufacturing machinery to be capable of providing the correct amount of heat, and for maintaining the rate of heat delivery at the requisite amount for insuring that all portions, both near the surface and deep within the sulfur concrete materials, be heated to the desired temperature and be permitted to cool at the desired rate.

Heretofore, pipe manufacturing machinery has not had the capability for satisfactorily performing all of the foregoing heat control functions while centrifuging sulfur concrete material. Furthermore as experience develops in the utilization and manufacture of sulfur concrete pipe, further variations in temperature and pressure profiles during the manufacturing process may become necessary. Present day equipment does not have the capacity for providing such variation in temperature and pressure required for optimizing strength and corrosion resistance of the sulfur concrete pipe.

SUMMARY OF THE INVENTION

The foregoing problems are overcome and other advantages are provided by a pipe fabricating machine for use with sulfur concrete. In accordance with the invention, the machine includes temperature sensors for sensing the temperature of heat applied to the mixture of sulfur cement and aggregate. The machine includes a centrifuge for centrifuging the mixture while heating the mixture and monitoring the temperature thereof. As an optional feature, the machine may also be provided with apparatus for radially pressing the mixture subsequent to the centrifuging. Also a vibration device is provided for vibrating the centrifuge to insure compaction of the mixture.

In accordance with a further feature of the invention, a computer is utilized with the machine. The computer includes circuitry for computing the difference between temperatures sensed at the inlet and outlet of the heat source. A steam draft is applied to the centrifuge whereby the rate of heat delivery to the mixture and the centrifuge is established. Also, the computer is provided with a memory addressed by the computed temperature of the mixture for establishing rates of heat delivery for increasing and decreasing temperature as a function of time. Thereby, a temperature profile of the mixture is stored within the computer memory. A clock drives the computer for timing the assembly operation. Output digital signals of the computer are decoded and applied via digital-to-analog converters which in turn activate apparatus for heating, cooling, centrifuging and vibrating the centrifuge drum containing the concrete mixture.

BRIEF DESCRIPTION OF THE DRAWING

The foregoing aspects and other features of the invention are explained in the following description taken in connection with the accompanying drawing which has a single FIGURE which shows certrifuge apparatus of the machine in section, the centrifuge being coupled to other control elements shown in diagrammatic form.

DESCRIPTION OF THE PREFERRED EMBODIMENT

In the manufacture of sulfur concrete, sulfur is mixed with an aggregate such as sand and/or gravel. Prior to the mixing, the sulfur is first modified by a modifier such as dicylopentadiene (DCPD), and oligomers of cyclopentadiene. For example, a sulfur in molten state may be reacted for several hours with a 5% by weight mixture of DCPD. The modified sulfur may then be cooled so as to provide the modified sulfur in powdered form or, alternatively, the sulfur may be utilized in the liquid form during the mixing of the sulfur with the aggregate. By way of example, the modified sulfur, known as sulfur cement, may be employed in a mix containing 16% sulfur cement with 76% aggregate and 8% of powdered silica to improve the workability of the mix.

The physical state of the sulfur cement, whether liquid or solid, depends on the temperature of the sulfur cement. Subsequent to forming the sulfur concrete, should the concrete be heated to a temperature above the melting point of sulfur, the sulfur separates out from the concrete as liquid sulfur. Thus, the physical reaction is reversible, namely, the modified sulfur can be liquified or returned to solid state by simply varying the temperature thereof; and similarly, the liquid state of the sulfur and the concrete mix can be obtained by suitable variation in the temperature thereof. Typical working temperatures in the production of the sulfur concrete, when it is desired that the modified sulfur should be in liquified form, would be in the range of 270° to 300° F.

In the event that the solid form, a powdered form, of the sulfur cement is to be mixed with the aggregate, vibration and compaction of the mixture are advantageously employed to insure good density and thorough mixing of the constituents. The subsequent heating of the mixture to produce a liquification of the sulfur cement is relatively time consuming due to the poor thermal conductivity of the compacted mixture. Greater speed in the fabrication of the sulfur concrete can be obtained by first heating the aggregate and then adding the sulfur cement to the heated aggregate. If desired, the sulfur cement may be preheated to a temperature slightly below the melting point thereof, should it be desired to mix constituents in powdered form prior to the liquification of the sulfur. Alternatively, all of the ingredients can be heated to a temperature well above the melting point of the sulfur cement, whereupon the liquified sulfur is mixed with the aggregate.

The resulting sulfur concrete sets up quickly, and shows substantial resistance to deformation after only one hour of curing. Curing may be done in a mold used in forming an object of the sulfur concrete or it may be done outside of the mold, assuming that the mold is removed without damaging the shape of the object which has been molded. Of course, the sulfur concrete must be cooled below the melting temperature of sulfur, to produce rigidity to the molded object, prior to removal from the mold.

With reference to the FIGURE, apparatus 20 for manufacturing a molded object, herein a section of pipe, comprises an inner cylinder 22, an outer cylinder 24 and a perforated cylinder 26 having a rubber liner 28, all of which are mounted on a rotatable base 30. The three cylinders 22, 24 and 26 are coaxial, there being a space between the perforated cylinder 26 an the inner cylinder 22 for reception of the mixture of sulfur cement and aggregate. The outer cylinder 24 is spaced apart from the perforated cylinder 26 to provide a passage for compressed air delivered by a tube 32 for reasons which will become apparent subsequently herein. The compressed air delivered by the tube 32 is applied via apertures 34 in the perforated cylinder 26 against the liner 28 for urging the liner 28 inwardly against a mixture of the sulfur cement and the aggregate. The space between the outer cylinder 24 and the perforated cylinder 26 is closed off by a flange 36 at the top of the wall of the cylinder 24, the bottom of the air space being closed off by the base 30.

A pipe 38 extends downwardly from a central bore 40 of the base 30. The pipe 38 supports the base 30, and passes through a ring gear to a fixed support 44 to which it is rotatably secured against vertical and horizontal thrusts by bearings 46, shown diagrammatically. The tube 32 enters through the wall of the pipe 38 via an aperture 48 and then passes outwardly along the axis of the pipe 38 and through the fixed support 44. A rotary joint 50 is provided within the tube 32 at the site of the support 44 for permitting rotation of the uper portion of the tube 32 about the lower portion thereof. The lower portion of the tube 32 connects with an air pressure source 50.

The ring gear 42 connects with a pinion 52, the pinion 52 being driven by a drive unit 54 for rotation of the base 30 and the cylinders 22, 24 and 26 being mounted thereon.

The inner cylinder 22 is partially closed off at its top by a flange 56 having a central opening which communicates with a section of pipe 58. The pipes 38 and 58 serve to communicate steam to the inner chamber 60 bounded by the inner cylinder 22. The steam in the chamber 60 is provided by a steam source 62, the steam in the chamber 60 serving to heat a concrete mixture in the space between the inner cylinder 22 and the perforated cylinder 26. Each of the cylinders 22, 24 and 26 are fabricated of a thermally conducting metal, such as steel, to permit heating and cooling of the mixture. A thermometer 64 in the inlet at the bottom of the pipe 38 measures the steam inlet temperature, while a thermometer 66 in the pipe 58 measures the outlet temperature of the steam. A higher inlet temperature shows that heat is being withdrawn from the steam and into the concrete mixture as well as into the physical structure of the cylinders 22, 24 and 26 as well as into the base 30, hereinafter to be referred to as drum 68. The drum 68 is rotatably connected with a vibrator 70 whereby the vibrator 70 imparts vibrations to the drum 68 as the drum 68 rotates. While the temperature of the drum 68 and its contents can be varied by adjustment of the temperature and rate of flow to the steam from the source 62; still further versatility in the control of the temperature, particularly with respect to a rapid cooling of the temperature, can be accomplished by a source of cold air, such a cold air source 72 being shown coupled diagrammatically to the input end of the pipe 38.

The apparatus 20 further comprises a computer 74 having a memory 76 and circuitry 78 for computation of the difference in the temperatures measured by the thermometers 64 and 66. The computer 74 is coupled via electric lines 80 and 82, respectively, to the inlet and outlet thermometers 64 and 66 whereby electrical signals designating the temperatures measured are coupled to the computer 74. The computer 74 is driven by a clock 84 and provides output electrical signals in digital format to decoders 86, 87, 88, 89 and 90. The digitally formated signals of the decoders 86, 87, 88, 89 and 90 are converted, respectively, by digital-to-analog converters 92, 93, 94, 95 and 96 to analog signals for operating, respectively, a vibrator 70, the drive unit 54, the air pressure source 50, the steam source 62, and the cold air source 72. The signals of the converters 92–96 are shown converging into a common line 98, and then fanning out from the line 98 to the respective units which are to be operated by these signals. Also shown in the FIGURE is a graph 100, appended to the computer 74, for illustrating the operation of the memory 76. An upper trace shows a variation in steam temperature, and/or delivery rate, as a function of the computed temperature of the drum 68 and its contents at a specific instant of time during the operation of the concrete forming process. The lower trace of the graph 100 shows the relationship at a subsequent instant of time during the concrete forming process.

In operation, the curcuitry 78 and the computer 74 compute the difference in temperatures measured by the inlet and outlet thermometers 64 and 66. In addition, the computer calculates the average value of the two temperatures and integrates the average value to determine the actual value of the temperature of the mixture of sulfur and aggregate. In accordance with a set of relationships stored in the memory 56, two such relationships exemplified by the graph 100, and in accordance with the length of time elasped in the process as designated by the clock 84, the memory 76 is addressed to provide the requisite values of the control signals on line 98 for operating the elements connected thereto.

Accordingly, the apparatus 20 operates to provide the successive steps in the process of the manufacture of the sulfur concrete pipe. First, the constituents are fed into the space between the inner cylinder 22 and the perforated cylinder 26. The constituents may be either hot or cold initially in accordance with the specific program to be implemented by the computer 74. Thereupon the drum 68 is brought up to speed and the vibrator 70 is operated to compact the mixture and to force it into the cylindrical shape desired for the resultant concrete pipe (not shown). The steam source 62 is activated to bring the mixture to the desired temperature and, along with activation of the cold air source 72, provides variations in the temperature as are useful in the curing process to induce desired states of crystalization of the sulfur. Further data on the manufacture and operation of a machine employing steam heating in the construction of tubular bodies is shown in U.S. Pat. No. 1,203,543 which issued in the name of Haymaker, et al. on Oct. 31, 1916. Further data on the manufacture and operation of a drum having a flexible liner, such as the rubber liner 28 in the manufacture of pipe is provided by the U.S. Pat. No. 2,342,801 which issued in the name of Guerci on Feb. 29, 1944.

The process of compaction of the mixture may be done near the beginning, during the middle, or during the end state of the concrete forming process depending on the desired properties of the resultant sulfur concrete. During the process of compaction, the air pressure source 50 is activated to drive air pressure up the tube 32 into the drum 68 for forcing the liner 28 towards the inner cylinder 22, thereby to compact the mixture by a force which is directed radially inward and thereby tends to decrease the diameter of the resultant pipe. The inward forcing of the air pressure against the liner 28 thus tends to reduce any curing stresses which may develop within the concrete sulfur pipe.

While the forgoing description of the invention has taught the use of a rotating drum for imparting the shape of a pipe to a sulfur concrete mix, with a resilient liner driven by air pressure to compact the particles of the mix and relieve stress, it is to be understood that the temperature control and curing features of the invention can be accomplished with other forms of pipe shaping equipment as is known in the pipe making industry. For example, a packer head type of concrete pipe machine, as is disclosed in the U.S. Pat. No. 2,530,687 issued in the name of Dixon, employs a set of trowels driven circularly around a shaft within a cylindrical jacket for imparting a pipe shape to a dry mix (minimal water) of concrete.

Alternatively, the pipe may be shaped in a horizontal rotating drum using a peripheral vibrator for compaction of the mix as is taught in the U.S. Pat. No. 2,703,916 issued in the name of Butler. As further example, the mix may be given a desired shape by use of a rotating drum in conjunction with a longitudinal roller shaft adjacent the inner surface of the drum for compacting and shaping the concrete mix to produce the desired shape, such apparatus being disclosed in the U.S. Pat. Nos. 2,772,465 in the name Rensselaer and 2,829,418 in the name of Truswell. In the use of each of the foregoing pipe making machines, the drum or jacket is to be heated and later cooled, the temperature being sensed to serve as an input parameter to a computer for control of the requisite thermal pattern for proper curing as taught above with reference to the preferred embodiment of the invention.

It is to be understood that the above described embodiment of the invention is illustrative only and that modifications thereof may occur to those skilled in the art. Accordingly this invention is not to be regarded as limited to the embodiment disclosed herein, but is to be limited only as defined by the appended claims.

I claim:

1. A pipe fabrication machine comprising in combination:

centrifuging means for imparting a pipe shape to a mixture of sulfur cement and aggregate, heating means coupled to said centrifuging means for heating said mixture, said heating means directing heat through said centrifuging means, said centrifuging means having an open central region and a hollow shaft for guiding said heat therethrough during rotation of a drum of said centrifuging means, sensing means for sensing inlet temperature and outlet temperature of said heat while it is propagating through said centrifuging means, and computing means coupled to said sensing means for computing the present temperature of said mixture in said centrifuging means based on the difference between said inlet temperature and said outlet temperature, said computing means including a memory, said memory storing a predetermined relationship between the present temperature and a desired temperature of said mixture as a function of time, said memory outputting the desired temperature upon being addressed with the present temperature and time by said computing means, and wherein said heating means is connected to said computing means, said heating means being responsive to the desired temperature outputted by said memory for adjusting the flow of said heat to provide said desired temperature to said mixture in accordance with said stored relationship.

2. A machine according to claim 1 wherein said computing means includes circuitry for computing a difference of said input temperature and said output temperature, said circuitry providing for an averaging of said difference.

3. A machine according to claim 2 further comprising compressing means coupled to said centrifuge means for compressing said mixture during control of said flow of heat through said centrifuge means.

4. A machine according to claim 3 wherein said compressing means comprises a cylindrical liner and an air passageway, said liner being directed radially inward by pressure in said air passageway.

5. A machine according to claim 3 wherein said stored relationship in said computer provides for both heating and cooling said mixture as a function of time, and wherein said heating means includes both sources of steam and air for providing for said heating and said cooling of said mixture.

6. A pipe fabrication machine comprising in combination:

centrifuging means for imparting a a pipe shape to a mixture of sulfur cement and aggregate;

heating means coupled to said centrifuge means for directing heat therethrough to raise the temperature of said mixture;

sensing means positioned within said centrifuge means for sensing the temperature of said heat at an inlet and at an outlet to said centrifuge means; and computing means responsive to the sensing of said temperatures for computing an average value of temperature, said computing means providing control signals based on a stored relationship of said average temperature and time for operating said heating means to alter the temperature of said mixture in accordance with a predetermined temporal relationship.

7. A machine according to claim 6 further comprising force exerting means within said centrifuging means located circumferentially around said mixture for exerting a force radially inwards about said mixture, said force exerting means compacting said mixture for release of stress during a curing of said mixture, said centrifuging means having an open central region and a hollow shaft for guiding heat therethrough from said heating means during rotation of a drum of said means.

8. A machine according to claim 7 further comprising means rotatably coupled to said centrifuging means for vibrating said mixture during a variation in temperature of said mixture imposed by said heating means.

* * * * *